United States Patent [19]

Asano et al.

[11] 3,941,910

[45] Mar. 2, 1976

[54] OIL-COATED METAL SHEET

[75] Inventors: Hidejiro Asano; Yoshitaka Hiromae, both of Kitakyushu, Japan

[73] Assignee: Nippon Steel Corporation, Tokyo, Japan

[22] Filed: Aug. 14, 1973

[21] Appl. No.: 388,890

Related U.S. Application Data

[63] Continuation of Ser. No. 178,809, Sept. 8, 1971, abandoned.

[30] Foreign Application Priority Data

Sept. 10, 1970 Japan ..... 45-78832

[52] U.S. Cl. ..... 428/457; 106/243; 106/265; 252/57; 427/27; 427/405; 427/417; 428/467; 428/497

[51] Int. Cl.[2] ..... B32B 15/04; B32B 9/04

[58] Field of Search ..... 117/134, 167; 252/57; 106/14, 243, 265; 427/27, 405, 417; 428/457, 467, 497

[56] References Cited

UNITED STATES PATENTS

| | | | |
|---|---|---|---|
| 2,579,778 | 12/1951 | Allen | 117/134 X |
| 2,741,567 | 4/1956 | Otto | 117/134 |
| 2,884,338 | 4/1959 | Jenison | 117/68 |
| 3,542,687 | 11/1970 | Shannon et al. | 252/170 |

OTHER PUBLICATIONS

"Polar-type Rust Inhibitors," *Industrial and Engineering Chemistry*," Baker et al., pp. 137–144, Vol. 4, No. 1, (1949).

*Primary Examiner*—Harry J. Gwinnell
*Attorney, Agent, or Firm*—Toren, McGeady and Stanger

[57] ABSTRACT

An oil-coated metal sheet coated with a surface coating oil in an amount of from 0.05 – 1.0 g/B.B., said surface coating oil comprising diisodecyl phthalate and 0.1 –5% of one or more of a fatty acid having 14–18 carbon atoms.

2 Claims, No Drawings

OIL-COATED METAL SHEET

This is a continuation of application Ser. No. 178,809, filed on Sept. 8, 1971, now abandoned.

This invention relates to a metal sheet coated with a film of oil having durable lubricity and antioxidizability as well as excellent lacquerability.

In this invention, a metal sheet means chiefly sheets such as, steel sheet, aluminum sheet and tin plated-, chromate treated- or phosphate treated steel sheets. However, the invention is not limited merely to such, and a metal sheet for lacquer painting in which permanent lubricity is required and a surface-cleaned metal sheet are also included.

As for a surface coating oil for plated steel sheet and others, cotton seed oil or dioctyl sebacate (DOS) is used generally.

Excellent properties in coating workability, durable lubricity, antioxidizability and adhesiveness to a lacquer are required for such a surface coating oil.

Cotton seed oil as above mentioned possesses defects such as, the so-called eye holes — to which lacquer will not adhere — are formed when a lacquer is applied to the oil coated plated steel sheet. Also, such oils are oxidized within a short period, and thus the sheet loses its lubricity.

Although DOS above mentioned has no tendency to form eye holes as does cotton seed oil when a lacquer is applied, since DOS has a low viscosity, there is a tendency for the oil to accumulate at the edge when it is applied on the plated steel sheet, and printing of the sheet becomes impossible when such accumulation is extreme.

As a result of various investigations to solve the defects of conventional surface coating oils, the present inventors found that diisodecyl phthalate, $C_6H_4(COOC_{10}H_{21})_2$ is excellent as a surface coating oil for plated steel sheets. Diisodecyl phthalate itself is, as disclosed in Japanese Patent Publication No. Sho 42-9256, an excellent surface coating oil. However as a result of various investigations to obtain a better surface coating oil by using diisodecyl phthalate which has durable lubricity, the present inventors have found that the lubricity of diisodecyl phthalate is improved remarkably by the addition of 0.1 – 5% of a fatty acid having 14 to 18 carbon atoms. Sheets treated with such compositions show only minimal graze and scratch marks in the subsequent treatment of the product.

As fatty acids with the carbon number of 14 – 18, a saturated fatty acid, such as, stearic acid ($C_{17}H_{35}COOH$), palmitic acid ($C_{15}H_{31}COOH$) and myristic acid ($C_{13}H_{27}COOH$) as well as an unsaturated fatty acids, such as, oleic acid ($C_{17}H_{33}COOH$), linoleic acid ($C_{17}H_{31}COOH$) and linolenic acid ($C_{17}H_{29}COOH$) can be used beneficially.

The reason why the carbon number of the fatty acid is restricted to 14 – 18 in this invention is that lubricity improvement is not obtained when the carbon number is smaller than 14, and the solubility of the acid in diisodecyl phthalate decreases and the effect becomes less when the carbon number is greater than 18. On the other hand, the reason why the amount of the additive is restricted to 0.1 – 5% is that no effect is obtained below 0.1%, and no further promotion of the effect can be observed and the composition and use thereof becomes uneconomical when more than 5% is used.

The essential point of the present invention is a metal sheet which is coated with a surface coating oil in an amount 0.05 – 1.0 g/B.B., said surface coating oil comprising diisodecyl phthalate and 0.1 – 5% thereof of one or more of a fatty acid with a carbon number of 14 – 18.

In this invention, B.B. (base box) means the surface area which is occupied by 112 pieces of 14 × 20 in² sheets, corresponding to about 40 m². The reason why the coating amount of the oil in the inventive metal sheet is restricted to 0.05 – 1.0 g/B.B. is that a coating amount of less than 0.05 g/B.B. makes the lubricity of the metal sheet insufficient, i.e., does not reduce the friction coefficient sufficiently, and thus resulting in damage during transportation and working. On the other hand, an amount of more than 1.0 g/B.B. has a bad influence on the adhesiveness of the paint to the oil-coated metal sheet as well as on the printability thereof.

As for the coating method to obtain the metal sheet of this invention, an electrostatic spray coating or an emulsion coating may be applied.

Examples of the oil-coated metal sheet of this invention will be set forth together with the manufacturing method thereof in the following.

EXAMPLE 1

A surface cleaned, cold rolled steel sheet was electroplated with tin by a common process, and was coated with a surface coating oil having the following composition with a thickness of 0.15 g/B.B. by electrostatic spray coating.

| | |
|---|---|
| Diisodecyl phthalate | 99.5 parts |
| Stearic acid | 0.5 part |

EXAMPLE 2

A tin-plated steel sheet obtained by the same method as in Example 1 was coated with a surface coating oil having the following composition with a thickness of 0.25 g/B.B. by electrostatic spray coating.

| | |
|---|---|
| Diisodecyl phthalate | 99 parts |
| Palmitic acid | 1 part |

EXAMPLE 3

A tin-plated steel sheet obtained by the same method as in Example 1 was coated with a surface coating oil having the following composition with a thickness of 0.20 g/B.B. by electrostatic spray coating.

| | |
|---|---|
| Diisodecyl phthalate | 97 parts |
| Myristic acid | 3 parts |

EXAMPLE 4

A surface cleaned, cold rolled steel sheet was plated thinly with chromium by using a sargent bath, and was coated with a surface coating oil having a composition as in Example 2 with a thickness of 0.35 g/B.B. by electrostatic spray coating.

Testing results of the various properties of the oil-coated metal sheets obtained above are summarized in Table 1.

As it is obvious from Table 1, the oil-coated metal sheet of this invention has such superior characteristics that, as in the case of the coating with diisodecyl phthalate alone, the loss of coating oil during storage is small, the adhesiveness of paint to the oil-coated metal sheet is excellent and no formation of eye holes takes place at all. Moreover, in the oil-coated metal sheet of this invention, the lubricity of the product (friction coefficient $\mu$) is improved still more, thus contributing to the reduction of the formation of wounds during transportation and working.

Table 1

| Example No. | Lubricity (n) | Test Results | | | |
|---|---|---|---|---|---|
| | | Loss of the amount of coated oil (%)*4) | Adhesiveness of paint | Spreading of paint | Eye hole formation |
| 1 | 0.12 | 10 | excellent | excellent | none |
| 2 | 0.11 | 10 | " | " | " |
| 3 | 0.12 | 10 | " | " | " |
| 4 | 0.11 | 10 | " | " | " |
| A*1) | 0.15 | 10 | " | " | " |
| B*2) | 0.15 | 30 | " | " | violent |
| C*3) | 0.13 | 20 | " | " | none |

*1) tin-plated steel sheet coated with diisodecyl phthalate alone (0.15 g/B.B.)
*2) tin-plated steel sheet coated with cotton seed oil (0.15 g/B.B.)
*3) tin-plated steel sheet coated with DOS (0.15 g/B.B.)
*4) after storing in a thermostat at 38°C for 30 days

What is claimed is:

1. An oil-coated metal sheet coated with a surface coating oil in an amount of 0.05 – 1.0 g/B.B., said surface coating oil comprising diisodecyl phthalate and 0.1 – 5% of one or more of a fatty acid having 14 to 18 carbon atoms.

2. An oil-coated metal sheet according to claim 1, in which the fatty acid is selected from the group consisting of stearic acid, palmitic acid, myristic acid, oleic acid, linoleic acid and linolenic acid.

* * * * *